US006468728B2

(12) United States Patent
Helling

(10) Patent No.: US 6,468,728 B2
(45) Date of Patent: Oct. 22, 2002

(54) COLOR PHOTOGRAPHIC SILVER HALIDE MATERIAL

(75) Inventor: Günther Helling, Odenthal (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 09/887,195

(22) Filed: Jun. 22, 2001

(65) Prior Publication Data

US 2002/0022202 A1 Feb. 21, 2002

(30) Foreign Application Priority Data

Jun. 30, 2000 (DE) ..... 100 31 829

(51) Int. Cl.[7] ..... G03C 1/08; G03C 7/26; G03C 7/32

(52) U.S. Cl. ..... 430/551; 430/543; 430/546

(58) Field of Search ..... 430/551, 543, 430/546

(56) References Cited

U.S. PATENT DOCUMENTS 4,002,776 A * 1/1977 Braun et al. ..... 427/19

4,184,876 A 1/1980 Eeles et al. ..... 430/505

FOREIGN PATENT DOCUMENTS

DE 19 701 719 7/1998

* cited by examiner

*Primary Examiner*—Geraldine Letscher
(74) *Attorney, Agent, or Firm*—Connolly Bove Lodge & Hutz LLP

(57) ABSTRACT

A color photographic material comprising a support, at least one light-sensitive silver halide emulsion layer and at least one color coupler associated with said layer, characterized in that the material contains at least one compound of formula $$R^1—SO_2—NH—CO—R^2 \quad (I)$$

wherein $R^1$ and $R^2$ denote organic radicals, the N atom can also be deprotonated, and compound I is substantially colorless and does not couple to form colored compounds during the processing of the material, is distinguished by its steep gradation and in that a high color density is obtained with inexpensive compounds.

15 Claims, No Drawings

COLOR PHOTOGRAPHIC SILVER HALIDE MATERIAL

The invention relates to a colour photographic material comprising a support, at least one light-sensitive silver halide emulsion layer and at least one colour coupler associated with said layer.

It is known that colour couplers can be added to colour photographic materials. Colour couplers are understood to be compounds which react with the oxidation product of the colour developer during the processing of the material and which thus form the image dye, the optical density of which is designated as the colour density. The desired colour density can be achieved by using a large amount of coupler.

Couplers are very expensive, however, since it is very costly to synthesise them in the purity which is necessary for photographic materials. Moreover, in the prior art no success has been achieved in obtaining the optimum colour density and a steep gradation simultaneously.

The underlying object of the present invention is thus to provide a material with which a high colour density is achieved with compounds which are inexpensive, i.e. which are not couplers, wherein the material is distinguished by a steep gradation.

Surprisingly, it has now been found that this object is achieved if colourless carbonimidosulphones are used in a colour photographic silver halide material which contains at least one colour coupler.

The present invention therefore relates to a colour photographic material comprising a support, at least one light-sensitive silver halide emulsion layer and at least one colour coupler associated with said layer, characterised in that the material contains at least one compound of formula

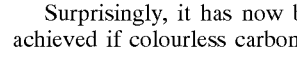

$$R^1—SO_2—NH—CO—R^2 \quad (I)$$

wherein $R^1$ and $R^2$ denote organic radicals, the N atom can also be deprotonated and compound I is substantially colourless and does not couple to form coloured compounds during the processing of the material.

Due to its high acidity, the N atom can also exist in deprotonated form, and compound I can be a salt. It is then represented as follows:

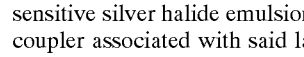

$$R^1—SO_2—N^{(-)}—CO—R^2\ M_n^{(+)} \quad (Ia)$$

wherein $M^{(+)}$ is a monovalent cation, and can therefore also be a proton, and n is equal to 0 if $R^1$ or $R^2$ carry an excess positive charge, and n is otherwise equal to 1. Moreover, compound I is always to be understood below to include compound Ia.

The group between the radicals $R^1$ and $R^2$ is hereinafter called a carbonimido-sulphone group, and compounds of formula I are called carbonimidosulphones.

Coupling is defined as a reaction with the developer oxidation product during the processing of the material, particularly a reaction with the oxidation product of a para-phenylenediamine developer substance.

"Substantially colourless" means that the compound of formula I, in the amount used, has an optical density of 0.05 at most in the wavelength region of visible light due to its inherent coloration.

The preferred compounds I are those in which $R^1$ and $R^2$ are bonded via a C atom to the carbonimidosulphone group.

In one advantageous embodiment, $R^1$ and $R^2$, independently of each other, are aryl, alkyl, cycloalkyl, aryl-substituted alkyl, alkyl-substituted aryl, alkenyl or cycloalkenyl groups, or a heterocycle, wherein these radicals can be substituted and can contain heteroatoms.

$R^1$ and $R^2$ preferably represent, independently of each other, an aryl, alkyl, cycloalkyl, aryl-substituted alkyl, alkyl-substituted aryl, alkenyl or cycloalkenyl group, wherein at least one of the $R^1$ or $R^2$ radicals comprises more than 5 C atoms.

$R^1$ most preferably denotes an unsubstituted or substituted phenyl ring, wherein one or two alkyl radicals, chlorine atoms, or acyl or ether radicals are advantageous as substituents of the phenyl ring in each case.

$R^1$ most advantageously denotes an unsubstituted, mono- or di-methyl-, mono- or di-chloro-, mono-acyl- or mono-ether-substituted phenyl ring.

$R^2$ most preferably denotes a long chain alkyl radical comprising at least 7 C atoms, a phenol ether-substituted alkyl radical, or a substituted phenyl, polymer, acrylic acid ester, benzoic acid ester or acyl radical, wherein the radical advantageously comprises at least 12 C atoms and most advantageously comprises at least 16 C atoms.

In another advantageous embodiment, $R^2$ denotes a fluorine-substituted alkyl radical, particularly a monofluoromethyl or perfluoroalkyl radical comprising 1 to 6 C atoms.

Examples of colour photographic materials which contain colour couplers include colour negative films, colour reversal films, colour positive films, colour photographic paper and colour reversal photographic paper. A review is given in Research Disclosure 37038 (1995) and in Research Disclosure 38957 (1996).

Photographic materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285 and in Research Disclosure 38957, Part XV (1996), page 627.

Colour photographic materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated for the most important products:

Colour photographic films such as colour negative films and colour reversal films comprise, in the following sequence on their support: 2 or 3 red-sensitive, cyan coupling silver halide emulsion layers, 2 or 3 green-sensitive, magenta coupling silver halide emulsion layers, and 2 or 3 blue-sensitive, yellow coupling silver halide emulsion layers. The layers of identical spectral sensitivity differ as regards their photographic speed, wherein the less sensitive partial layers are generally disposed nearer the support than are the more highly sensitive partial layers.

A yellow filter layer is usually provided between the green-sensitive and blue-sensitive layers, to prevent blue light from reaching the layers underneath.

The options for different layer arrangements and their effects on photographic properties are described in J. Inf. Rec. Mats., 1994, Vol. 22, pages 183–193, and in Research Disclosure 38957, Part XI (1996), page 624.

Colour photographic paper, which as a rule is less sensitive to light than is colour photographic film, usually comprises the following layers on the support, in the following sequence: a blue-sensitive, yellow coupling silver halide emulsion layer, a green-sensitive, magenta coupling silver halide emulsion layer, and a red-sensitive, cyan coupling silver halide emulsion layer. The yellow filter layer can be omitted.

Departures from the number and arrangement of the light-sensitive layers may be effected in order to achieve defined results. For example, all the high-sensitivity layers may be combined to form a layer stack and all the low-sensitivity layers may be combined to form another layer stack in a photographic film, in order to increase the sensitivity (DE 25 30 645).

The essential constituents of the photographic emulsion layer are binders, silver halide grains and colour couplers.

Information on suitable binders is given in Research Disclosure 37254, Part 2 (1995), page 286, and in Research Disclosure 38957, Part II.A (1996), page 598.

Information on suitable silver halide emulsions, their production, ripening, stabilisation and spectral sensitisation, including suitable spectral sensitisers, is given in Research Disclosure 37254, Part 3 (1995), page 286, in Research Disclosure 37038, Part XV (1995), page 89, and in Research Disclosure 38957, Part V.A (1996), page 603.

Photographic materials which exhibit camera-sensitivity usually contain silver bromide-iodide emulsions, which may also optionally contain small proportions of silver chloride. Photographic copier materials contain either silver chloride-bromide emulsions comprising up to 80 mol % AgBr, or silver chloride-bromide emulsions comprising more than 95 mol % AgCl.

Information on colour couplers is to be found in Research Disclosure 37254, Part 4 (1995), page 288, in Research Disclosure 37038, Part II (1995), page 80, and in Research Disclosure 38957, Part X.B (1996), page 616. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

2- and 4-equivalent colour couplers are preferably used, wherein open-chain ketomethylenes, or pivaloyl, benzoyl, malonamide, pyrazolone, pyrazolotriazole, pyrrolotriazole or pyrazolobenzimidazole couplers, or phenolic or naphtholic couplers, are used particularly advantageously.

In order to improve sensitivity, granularity, sharpness and colour separation, compounds are frequently used in colour photographic films which on reaction with the developer oxidation product release compounds which are photographically active, e.g. DIR couplers, which release a development inhibitor.

Information on compounds such as these, particularly couplers, is to be found in Research Disclosure 37254, Part 5 (1995), page 290, in Research Disclosure 37038, Part XIV (1995), page 86, and in Research Disclosure 38957, Part X.C (1996), page 618.

The colour couplers, which are mostly hydrophobic, and other hydrophobic constituents of the layers also, are usually dissolved or dispersed in high-boiling organic solvents (oil-formers). These solutions or dispersions are then emulsified in an aqueous binder solution (usually a gelatine solution), and after the layers have been dried are present as fine droplets (0.05 to 0.8 $\mu$m diameter) in the layers. Compounds of formula I are preferably contained in these droplets of emulsion.

Suitable high-boiling organic solvents, methods of introducing them into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitisation.

Suitable compounds (white couplers, scavengers or DOP scavengers) are described in Research Disclosure 37254, Part 7 (1995), page 292, in Research Disclosure 37038, Part III (1995), page 84, and in Research Disclosure 38957, Part X.D (1996), page 621 et seq.

The photographic material may additionally contain compounds which absorb UV light, optical brighteners, spacers, filter dyes, formalin scavengers, light stabilisers, antioxidants, $D_{Min}$ dyes, plasticisers (latices), biocides, additives for improving the dye-, coupler- and white stability, additives to reduce colour fogging and to reduce yellowing, and other substances. Suitable compounds are given in Research Disclosure 37254, Part 8 (1995), page 292, in Research Disclosure 37038, Parts IV, V, VI, VII, X, XI and XIII (1995), page 84 et seq., and in Research Disclosure 38957, Parts VI, VIII, IX, X (1996), pages 607, 610 et seq.

The layers of colour photographic materials are usually hardened, i.e. the binder used, preferably gelatine, is crosslinked by suitable chemical methods.

Suitable hardener substances are described in Research Disclosure 37254, Part 9 (1995), page 294, in Research Disclosure 37038, Part XII (1995), page 86, and in Research Disclosure 38957, Part II.B (1996), page 599.

After image-by-image exposure, colour photographic materials are processed by different methods corresponding to their character. Details on the procedures used and the chemicals required therefor are published in Research Disclosure 37254, Part 10 (1995), page 294, in Research Disclosure 37038, Parts XVI to XXIII (1995), page 95 et seq., and in Research Disclosure 38957, Parts XVIII, XIX, XX (1996), together with examples of materials.

The compounds according to the invention are preferably used together with colour couplers, such as yellow, magenta, cyan and black couplers, DIR couplers, masking couplers, BAR couplers, ETAR couplers, FAR couplers, white couplers, stabilisers, UV absorbers, scavengers, dyes, optical brighteners, oil-formers or a plurality of these compounds. It is preferable if at least one compound of formula I is contained with at least one of the other compounds in the same layer, most preferably as a preparation, e.g. as a dispersion or an emulsion.

Compounds of formula I can be added to the material at any location. This applies in particular to substances of low molecular weight which are capable of migrating within the layered composite.

Compound I is preferably used in the same layer in which a coupler, particularly a coupler which gives rise to an image dye, is also contained. It is most preferably used in the layer containing the colour coupler, the colour density of which is to be increased.

Compound I can be added to one or more layers of the material, e.g. as a solution, dispersion or emulsion. The compound is preferably dissolved or dispersed together with a coupler and is then used as an emulsion. It is advantageous if compound I is incorporated together with the colour coupler, the colour density of which is to be increased.

It is particularly advantageous if compound I is emulsified with the coupler, particularly the colour coupler, and an oil-former. It is also advantageous if the emulsion also contains a stabiliser, particularly an image dye stabiliser.

Suitable image dye stabilisers (image stabilisers) are described, for example, in Res. Discl. 9, 1996, page 621 et seq.

Image stabilisers which are particularly preferred are the compounds ST-I and ST-II described in DE 19 701 719 A1, on page 2, especially the compounds ST-1 to ST-44 on pages 5 to 13 of said Application.

The compound of structure I is preferably contained in the material in an amount of 0.01 to 3 g per $m^2$ in each layer in which it is used. If compound I is present in a layer together with at least one coupler, an amount of 0.01 to 3 g of compound I/g all the couplers in this layer is preferred.

The present invention further relates to a colour photographic material comprising a support and at least one light-sensitive silver halide emulsion layer, which comprises at least one colour coupler associated with said layer, characterised in that the material contains at least one compound of formula $$R^3—SO_2—NH—CO—R^4 \quad (I)$$

wherein $R^3$ and $R^4$, independently of each other, can be aryl, alkyl, cycloalkyl, aryl-substituted alkyl, alkyl-substituted aryl, alkenyl or cycloalkenyl groups, at least one of the $R^3$ or $R^4$ radicals comprises more than 5 C atoms, and the N atom can also be deprotonated.

Further preferred embodiments of the invention are given in the subsidiary claims.

Examples of preferred compounds of formula I are illustrated below.

V-1

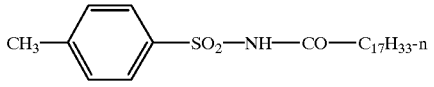

V-2

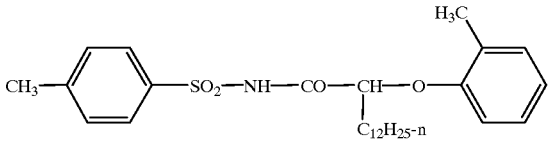

V-3

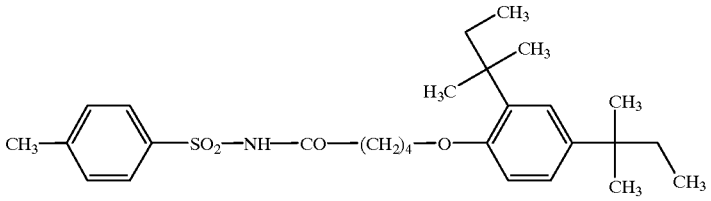

V-4

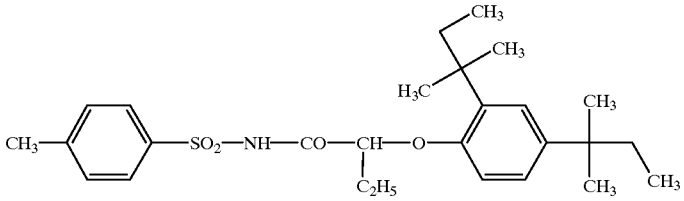

V-5

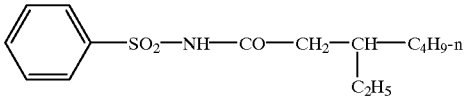

V-6

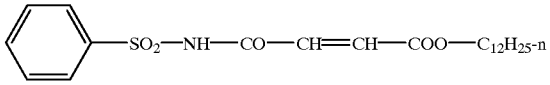

V-7

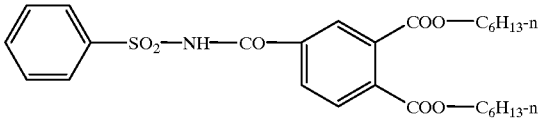

V-8

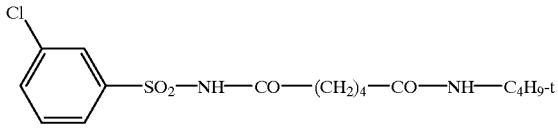

V-9

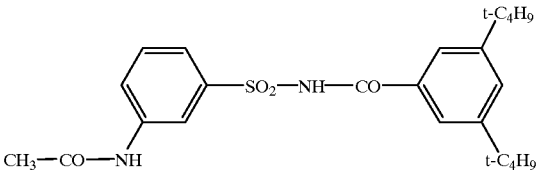

V-10

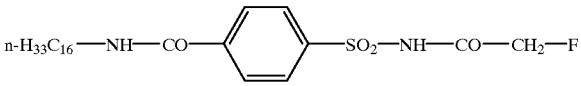

V-11

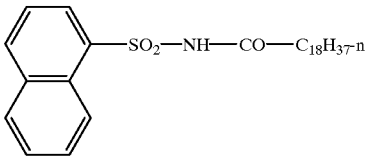

V-12

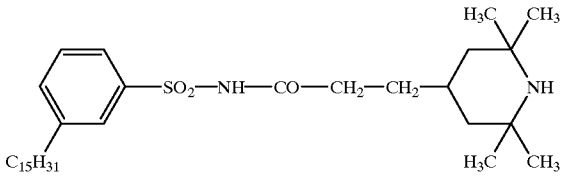

-continued
V-13
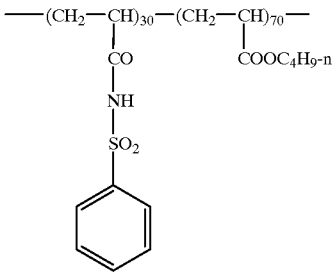
V-14
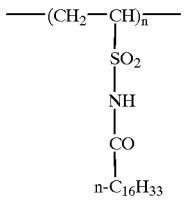
V-15
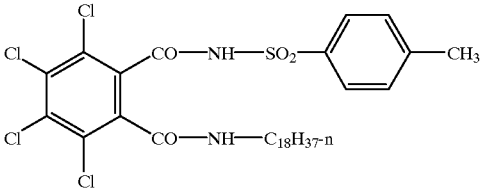
V-16
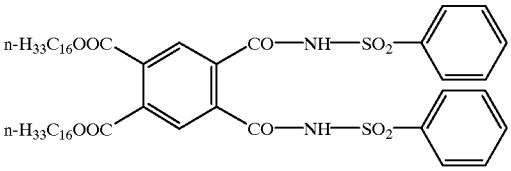
V-17
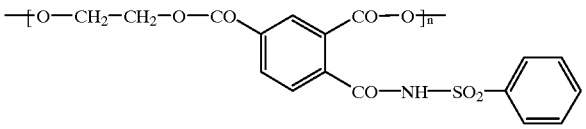
V-18
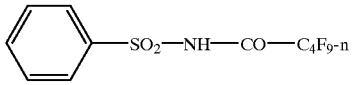
V-19
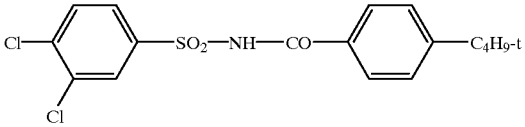
V-20
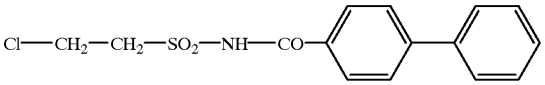
V-21
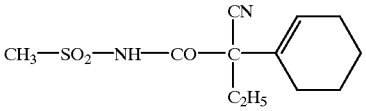
V-22
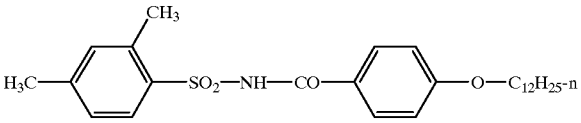
V-23
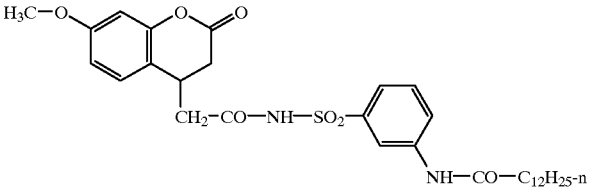
V-24
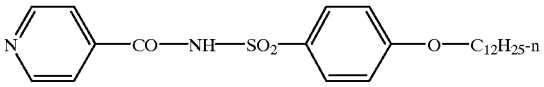
V-25
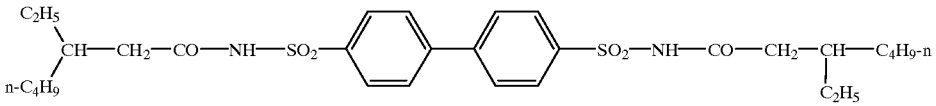
V-26
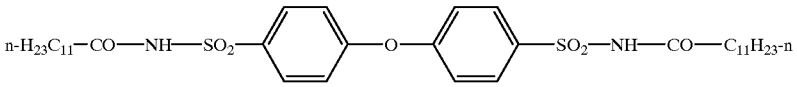
V-27
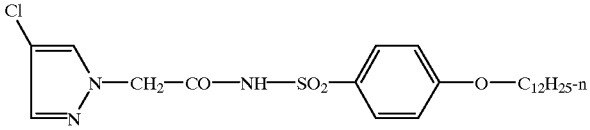
V-28
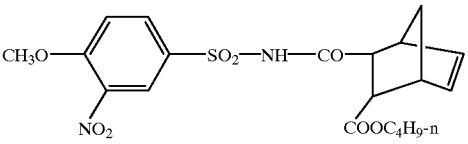

The compounds according to the invention can be synthesised inexpensively by the reaction of sulphonamides with carboxylic acid chlorides. The synthesis of compound V-1 according to the invention is described below as an example.

V-1

34.2 g p-toluenesulphonamide and 66.7 g stearic acid chloride were mixed with 200 g acetonitrile and stirred for 6 hours at the boiling temperature. Thereafter, 200 g ethanol and 3 g Fuller's earth (argillaceous silica) were added. After filtering off the solids and cooling, the substance crystallised out. After filtration under suction and drying, 74 g of compound V-1 were obtained. Melting point: 99° C.

EXAMPLES

Example 1

A colour photographic recording material was produced by depositing the following layers in the given sequence on a film base comprising paper coated on both sides with polyethylene. The quantitative data are given with respect to 1 $m^2$ in each case. The corresponding amounts of $AgNO_3$ are quoted for silver halide deposition.

| Layer structure 1 | |
|---|---|
| Layer 1 | (substrate layer)<br>0.10 g gelatine |
| Layer 2 | (blue-sensitive layer)<br>a blue-sensitive silver halide emulsion (99.5 mol % chloride, 0.5 mol % bromide, average grain diameter 0.9 $\mu$m), comprising 0.50 g $AgNO_3$, with<br>1.25 g gelatine<br>0.42 g yellow coupler Y-1<br>0.18 g yellow coupler Y-2<br>0.50 g tricresyl phosphate (TCP)<br>0.10 g stabiliser ST-1<br>0.70 mg blue sensitiser BS-1<br>0.30 mg stabiliser ST-2 |
| Layer 3 | (intermediate layer)<br>1.10 g gelatine<br>0.12 g scavenger SC-1<br>0.12 g tricresyl phosphate (TCP) |
| Layer 4 | (green-sensitive layer)<br>a green-sensitive silver halide emulsion (99.5 mol % chloride, 0.5 mol % bromide, average grain diameter 0.47 $\mu$m), comprising 0.28 g $AgNO_3$, with<br>1.0 g gelatine<br>0.21 g magenta coupler M-1<br>0.15 g stabiliser ST-3<br>0.15 g stabiliser ST-6<br>0.21 g diisodecyl phthalate (DIDP)<br>0.21 g isotridecanol (ITD)<br>0.70 mg green sensitiser GS-1<br>0.50 mg stabiliser ST-4 |
| Layer 5 | (UV protection layer)<br>0.95 g gelatine<br>0.30 g UV absorber UV-1<br>1.2 g scavenger SC-2<br>0.15 g oil-former OF-2<br>0.15 g TCP |
| Layer 6 | (red-sensitive layer)<br>a red-sensitive silver halide emulsion (99.5 mol % chloride, 0.5 mol % bromide, average grain diameter 0.5 $\mu$m), comprising 0.30 g $AgNO_3$, with<br>1.0 g gelatine<br>0.46 g cyan coupler C-1<br>0.46 g TCP<br>0.03 mg red sensitiser RS-1<br>0.60 mg stabiliser ST-5<br>0.30 g UV absorber UV-2 |

-continued

| Layer structure 1 | |
|---|---|
| Layer 7 | (UV protection layer)<br>0.30 g gelatine<br>0.10 g UV absorber UV-3<br>0.05 g oil-former OF-3<br>0.05 g oil-former OF-1 |
| Layer 8 | (protective layer)<br>0.90 g gelatine<br>0.05 g optical brightener WT-1<br>0.07 g polyvinylpyrrolidone<br>1.20 mg silicone oil<br>2.50 mg spacer (polymethyl methacrylate, average particle size 0.8 $\mu$m)<br>0.30 g hardener H-1 |

Compounds used in the examples:

Y-2

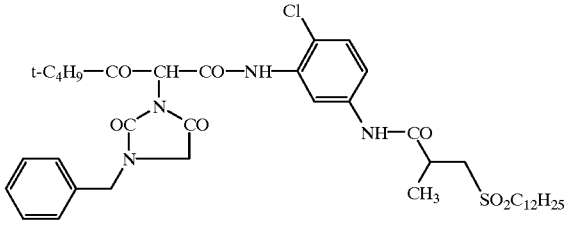

Y-1

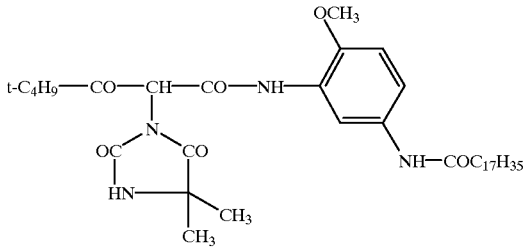

M-1

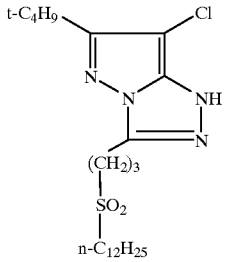

C-1

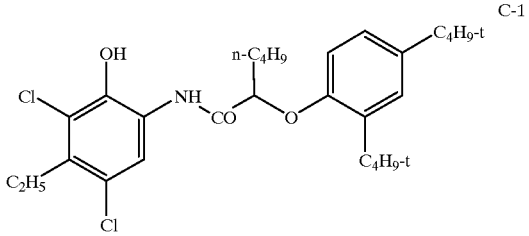

-continued
BS-1
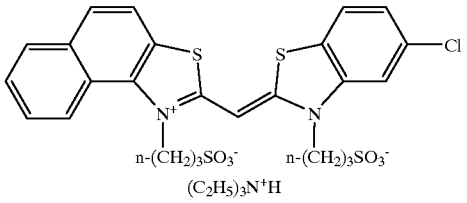
GS-1
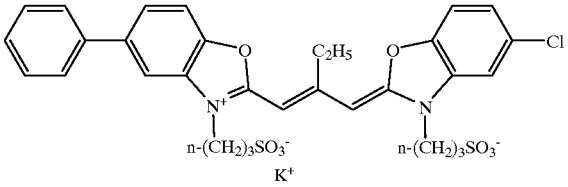
RS-1
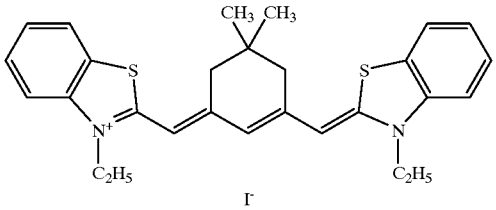
ST-1
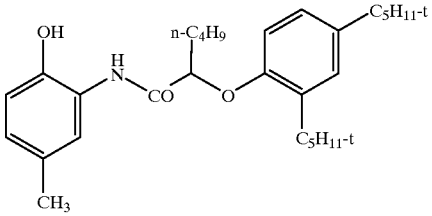
-continued
ST-2
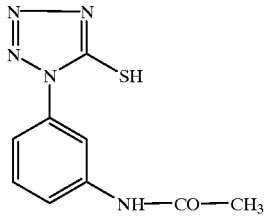
ST-3
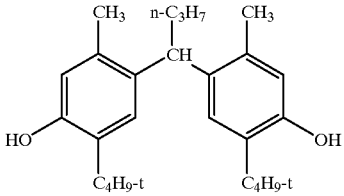
ST-4
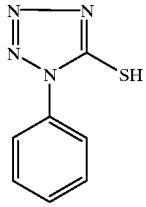
ST-5
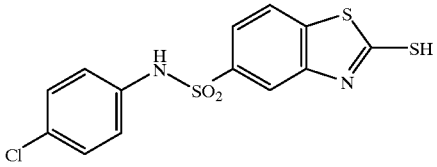
ST-6
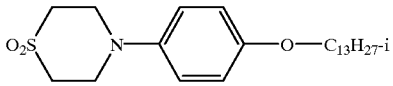
OF-1 polyester of $HO_2C—(CH_2)_4—CO_2H$, η(20° C.):4000–5000 mPa.s $HOCH_2—C(CH_3)_2—CH_2OH$ and $n_D$(20° C.): 1.464–1.467 $HO—C_{10}H_{21}$-i
OF-2 $—(CH_2—CH_2—CO_2—C_9H_{19}\text{-i})_2$
OF-3 $O{=}P\ (O—CH_2—CH(C_2H_5)—C_4H_9\text{-n})_3$ UV-1
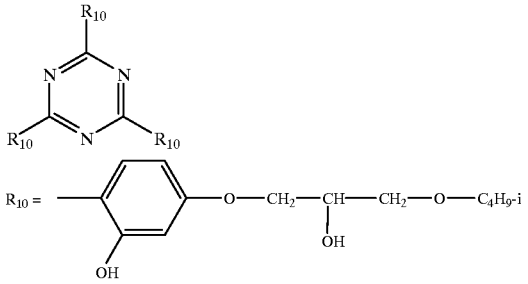
UV-2
4:1 a mixture of
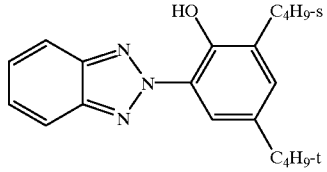
and
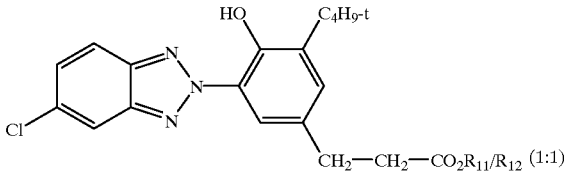
(1:1)
$R_{11}$ = —$C_8H_{17}$-n
$R_{12}$ = —$CH_2$—$CH(C_2H_5)$—$C_4H_9$-n
UV-3
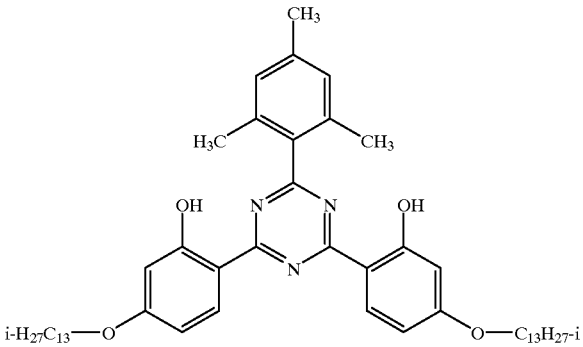
WT-1
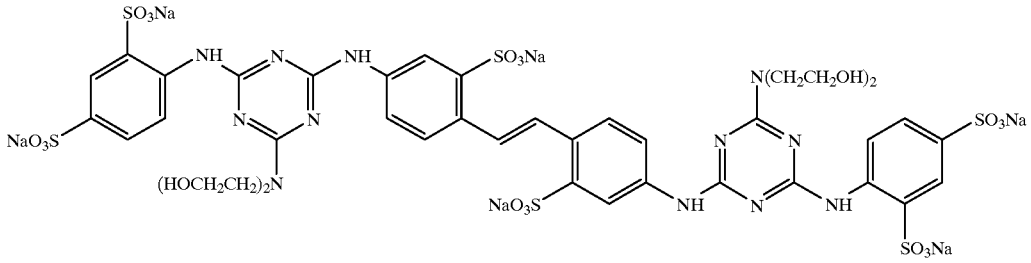
H-1
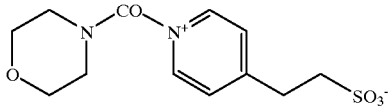
SC-1
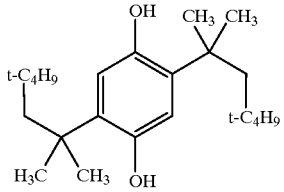
SC-2
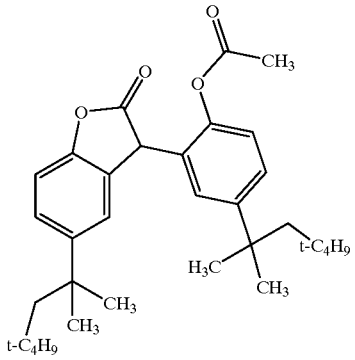

Layer structures 2 to 12

In layer structures 2 to 12, the compounds given in Table 1 were used in addition in layers 2.

All samples were exposed through a stepped photometric absorption wedge and a filter (yellow colour separation) and were subsequently processed as follows:

| | | |
|---|---|---|
| a) | Colour developer - 45 sec. - 35° C. | |
| | tetraethylene glycol | 20.0 g |
| | N,N-diethylhydroxylamine | 2.0 g |
| | N,N-bis-(2-sulphoethyl)-hydroxylamine, disodium salt | 2.0 g |
| | N-ethyl-N-(2-methanesulphonamidoethyl)-4-amino-3-methylbenzene sulphate | 5.0 g |
| | potassium sulphite | 0.2 g |
| | potassium carbonate | 30.0 g |
| | polymaleic anhydride | 2.5 g |
| | hydroxyethanediphosphonic acid | 0.2 g |
| | brightener (4,4'-diaminostilbenesulphonic acid derivative) | 2.0 g |
| | potassium bromide | 0.02 g |
| | made up with water to 1000 ml; | |
| | pH adjusted to pH 10.2 with KOH or $H_2SO_4$. | |
| b) | Bleach hardener - 45 sec. - 35° C. | |
| | ammonium thiosulphate | 75.0 g |
| | sodium hydrogen sulphite | 13.5 g |
| | ethylenediaminetetraacetic acid (iron ammonium salt) | 45.0 g |
| | made up with water to 1000 ml; | |
| | pH adjusted to pH 6.0 with ammonia (25% by weight) or acetic acid. | |
| c) | washing - 90 sec. - 33° C. | |
| d) | drying | |

Sensitometric data for yellow colour separation were then determined.

TABLE 1

| Layer structure | Addition of compound | | Amount $g \cdot m^{-2}$ | γ (yellow) | Colour density (yellow) |
|---|---|---|---|---|---|
| 1 | — | comparison | — | 1.64 | 2.18 |
| 2 | V-1 | invention | 0.06 | 1.73 | 2.42 |
| 3 | V-2 | invention | 0.06 | 1.71 | 2.47 |
| 4 | V-3 | invention | 0.06 | 1.75 | 2.48 |
| 5 | V-4 | invention | 0.06 | 1.70 | 2.39 |
| 6 | V-1 | invention | 0.10 | 1.71 | 2.38 |
| 7 | V-2 | invention | 0.10 | 1.74 | 2.45 |
| 8 | V-3 | invention | 0.10 | 1.73 | 2.39 |
| 9 | V-4 | invention | 0.10 | 1.73 | 2.41 |
| 10 | V-22 | invention | 0.06 | 1.71 | 2.47 |
| 11 | V-18 | invention | 0.06 | 1.72 | 2.40 |
| 12 | V-11 | invention | 0.14 | 1.75 | 2.42 |
| 13 | Y-3 | comparison | 0.06 | 1.68 | 2.38 |

As can be seen from Table 1, when the amount of coupler employed is kept constant, the addition of the compounds according to the invention results both in an increase in colour density and in a steeper gradation.

If a coupler containing a carbonimidosulphone radical is used instead of the compounds according to the invention, the results are less satisfactory than when the much less expensive substances according to the invention are used.

Y-3

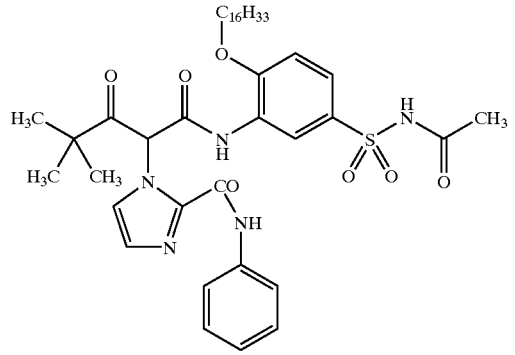

What is claimed is:

1. A color photographic material comprising a support, at least one light-sensitive silver halide emulsion layer and at least one color coupler associated with said layer, wherein the material contains at least one compound of formula $$R^1—SO_2—NH—CO—R^2 \quad (I)$$

wherein $R^1$ and $R^2$ independently from one another are organic radicals, the N atom is optionally deprotonated, and said compound I is substantially colorless and does not couple to form colored compounds during the processing of the material.

2. The color photographic material according to claim 1, wherein $R^1$ and $R^2$ are bonded via a C atom to the carbonimidosulphone group.

3. The color photographic material according to claim 1, wherein $R^1$ and $R^2$, independently of each other, are an aryl group, an alkyl group, a cycloalkyl group, an aryl-substituted alkyl group, an alkyl-substituted aryl group, an alkenyl group, a cycloalkenyl group or a heterocycle group, wherein each of said groups are optionally substituted and optionally contain heteroatoms.

4. The color photographic material according to claim 1, wherein $R^1$ and $R^2$, independently of each other, are an aryl, alkyl, cycloalkyl, aryl-substituted alkyl, alkyl-substituted aryl, alkenyl or cycloalkenyl group, wherein at least one of the $R^1$ and $R^2$ radicals comprises more than 5 carbon atoms.

5. The color photographic material according to claim 1, wherein said compound I is contained in an amount of 0.01 to 3 g per $m^2$ in each layer in which it is used.

6. The color photographic material according to claim 1, wherein said compound I is contained in the same layer as a coupler.

7. The color photographic material according to claim 6, wherein said compound I, together with said coupler, is dissolved, emulsified with an oil-former or dispersed.

8. The color photographic material according to claim 1, wherein said compound I, together with the color coupler in an amount of 0.01 to 3 g/g of the coupler, is either dissolved, emulsified with an oil-former or dispersed.

9. The color photographic material according to claim 8, wherein said compound I is emulsified with an oil-former and a stabilizer, wherein said stabilizer is an image dye stabilizer.

10. A color photographic material comprising a support and at least one light-sensitive silver halide emulsion layer, which comprises at least one color coupler associated with said layer, and the material contains at least one compound of formula $$R^3—SO_2—NH—CO—R^4 \quad (I)$$

wherein $R^3$ and $R^4$, independently of each other, are an aryl, alkyl, cyclo-alkyl, aryl- substituted alkyl, alkyl-substituted aryl, alkenyl or cycloalkenyl group, at least one of the $R^3$ or $R^4$ radicals comprises more than 5 carbon atoms, and the N atom is optionally deprotonated.

11. The color photographic material as claimed in claim 1, wherein said formula (I) is a compound of the formula (Ia)

$$R^1—SO_2—N^{(-)}—CO—R^2\ M_n^{(+)} \quad (I)$$

wherein $M^{(+)}$ is monovalent cation, n is equal 0 if $R^1$ or $R^2$ carry an excess positive charge, and n is otherwise equal to 1.

12. The color photographic material according to claim 5, wherein $R^1$ is an unsubstituted phenyl ring or a substituted phenyl ring substituted with 1 or 2 alkyl radicals, chlorine atoms, acyl or ether radicals.

13. The color photographic material according to claim 1, wherein $R^1$ is an unsubstituted phenyl ring, a mono-methyl substituted phenyl ring, a di-methyl substituted phenyl ring, a mono-chloro substituted phenyl ring, a di-chloro substituted phenyl ring, a mono-acyl substituted phenyl ring or a mono-ether substituted phenyl ring.

14. The color photographic material according to claim 1, wherein $R^2$ is an alkyl radical having at least 7 carbon atoms, a phenol-ether substituted alkyl radical, a substituted phenyl, polymer, acrylic acid ester, benzoic acid ester or acyl radical, wherein the radical advantageously contains at least 12 carbon atoms.

15. The color phototgraphic material according to claim 1, wherein $R^2$ is a fluorine substituted alkyl radical.

* * * * *